United States Patent [19]

McIlroy

[11] Patent Number: 4,979,711

[45] Date of Patent: Dec. 25, 1990

[54] DISPLAY CARD FOR THREE-DIMENSIONAL ORNAMENTAL ARTICLE

[75] Inventor: John C. McIlroy, Lapper, Mich.

[73] Assignee: A & H Mfg. Co., Johnston, R.I.

[21] Appl. No.: 347,929

[22] Filed: May 5, 1989

[51] Int. Cl.[5] ..... A47B 96/06

[52] U.S. Cl. ..... 248/214; 206/45.14; 248/309.1

[58] Field of Search ..... 248/214, 215, 309.1, 248/340; 211/13, 113; 40/651; 206/45.14, 468

[56] References Cited

U.S. PATENT DOCUMENTS

| | | | |
|---|---|---|---|
| 3,907,118 | 9/1975 | Pelavin | 248/214 X |
| 4,099,611 | 7/1978 | Feibelman | 206/45.14 |
| 4,175,660 | 11/1979 | Feibelman | 206/468 |
| 4,203,175 | 5/1980 | Heine | 248/215 X |
| 4,281,469 | 8/1981 | Feibelman | 40/651 |
| 4,322,007 | 3/1982 | Feibelman | 211/13 X |
| 4,504,992 | 3/1985 | Herron | 248/215 X |
| 4,648,144 | 3/1987 | Rose | 248/214 X |

*Primary Examiner*—J. Franklin Foss
*Attorney, Agent, or Firm*—Salter & Michealson

[57] ABSTRACT

A display card for three-dimensional ornamental articles includes a main card portion, a hanger portion for hanging the card from a display stand and a flange portion which extends forwardly from the card portion for suspending an ornamental article in free space in forwardly spaced relation to the front side of the card portion.

16 Claims, 1 Drawing Sheet

DISPLAY CARD FOR THREE-DIMENSIONAL ORNAMENTAL ARTICLE

BACKGROUND OF THE INVENTION

The instant invention relates to display apparatus and more particularly to a display card for displaying a three-dimensional ornamental article, such as a three-dimensional earring.

Over the years, display cards have been found to be highly effective for packaging and displaying ornamental articles, such as earrings and the like. In this regard, display cards of the general type disclosed in the U.S. Pat. Nos. 4,099,611; 4,175,660; 4,281,469; D. 2,61,729 and D. 264,820 to Feibelman have generally been found to be effective for displaying many types of jewelry items, such as earrings and the like and they are believed to represent the closest prior art to the subject invention of which the applicant is aware. Display cards of this general type have been adapted to be supported and displayed on display stands of the general type disclosed in the U.S. Pat. No. 4,322,007 to Feibelman and in most cases they have included a main card portion having one or more apertures therein which are adapted for receiving the fastening elements of ornamental articles in order to secure ornamental articles on the card portion. However, while display cards of this type have been found to be highly effective for displaying most types of ornamental jewelry items, they have been found to be less than entirely effective for displaying certain types of three-dimensional jewelry items which are intended to be worn so that they are suspended in free space. This has been found to be particularly true with respect to jewelry items which are formed as collapsible mobile-type structures and which therefore are only capable of displaying their true artistic forms when they are suspended in free space. The instant invention provides an effective display card which is specifically adapted for displaying three-dimensional ornamental articles such as mobile-type earrings so that they are suspended in free space. Specifically, the display card of the instant invention comprises a card portion, hanger means on the card portion for releasably hanging the display card from a display stand and a flange portion which extends forwardly from the card portion for suspending an ornamental article in free space in front of the card portion. The card portion is preferably substantially flat and the hanger means is preferably adapted for releasably securing the display card on a display stand so that the card portion is maintained in a substantially vertical disposition. The hanger means preferably comprises an elongated hanger portion which extends rearwardly from the card portion and then downwardly so that it is receivable on a hanger bar of a display stand of the general type disclosed in the aforementioned U. S. Pat. No. 4,322,007 to Feibelan. The flange portion preferably includes a substantially planar main portion which extends forwardly from the card portion, a front face portion which extends downwardly from the main portion and a bottom lip portion which extends rearwardly slightly from the front face portion in downwardly spaced relation to the main portion. The main portion of the flange portion preferably extends forwardly from the card portion by a least approximately one half inch and it is preferably adapted for suspending an ornamental article therefrom at a point which is spaced forwardly by at least approximately one half inch from the card portion. The front face portion of the flange portion is preferably adapted for suspending an ornamental article from the flange portion and it preferably has an aperture therein which is adapted for receiving the post of an ornamental article, such as an earring, in order to secure the earring to the face portion so that it is suspended in free space therefrom. In one embodiment of the display card the flange portion extends forwardly adjacent the upper edge of th card portion whereas in a second embodiment the flange portion extends forwardly in downwardly spaced, relation to the upper edge of the card portion to provide an area on the card portion above the flange portion which can be used for advertising, indicia, etc. The card portion, the flange portion and, in some cases, the hanger portion are preferably integrally extruded from a plastic material. Further, the display card is preferably adapted for displaying a pair of three-dimensional earrings and accordingly, the flange portion is preferably adapted for suspending a pair of three-dimensional earrings in spaced relation to each other in forwardly spaced relation to the card portion.

It has been found that the display card of the instant invention can be effectively utilized for packaging and displaying three-dimensional jewelry items, such as three-dimensional mobile type earrings. In this regard, it has been found that when articles, such as three-dimensional mobile-type earrings are displayed on the display card, the earrings are suspended in free space so that the natural artistic three-dimensional features thereof are clearly displayed to potential purchasers. Hence, it has been found that for certain applications the display card of the instant invention has significant advantages over the heretofore available display cards for ornamental articles.

Accordingly it is a primary object of the instant invention to provide an effective display device for displaying a three-dimensional ornamental article such as a three-dimensional jewelry item.

Another object of the instant invention is to provide a display card for displaying a pair of three-dimensional earrings.

An even further object of the instant invention is to provide an effective display card for displaying an ornamental article so that it is suspended in free space.

A still further object of the instant invention is to provide an effective display card for displaying a three-dimensional ornamental article so that it is suspended in free space in forwardly spaced relation to a card portion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
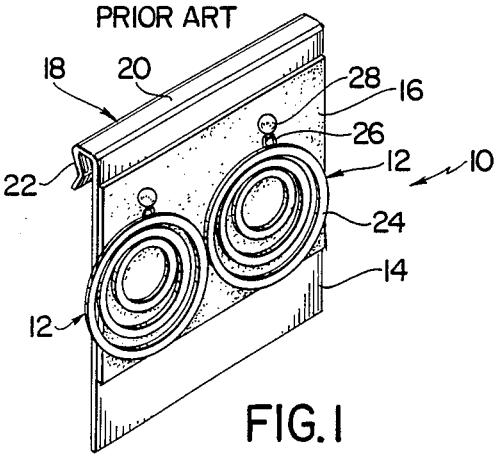
FIG. 1 is a perspective view of a display card of the prior art as it is used to display a pair of three-dimensional mobile-type earrings.
Figure 2:
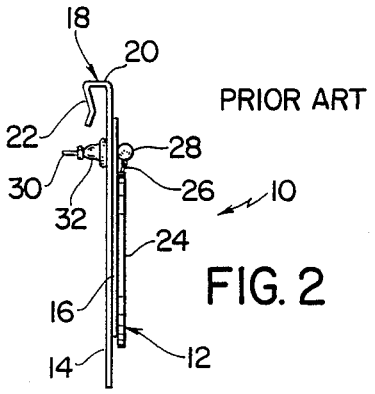
FIG. 2 is a side elevational view thereof.

Referring now to the drawing, a display card of the prior art is illustrated in FIGS. 1 and 2 and generally indicated at 10. The display card 10 is illustrated in combination with a pair of three-dimensional mobile-type earrings generally indicated at 12 and it comprises a substantially flat rectangular card portion 14 having a decorative layer 16 thereon and a hanger portion generally indicated at 18 on the card portion 14. The card portion 14 and the hanger portion 18 are integrally extruded from a suitable plastic material, and the decorative layer 16 which preferably comprises a decorative fabric is adhesively secured to the front side of card portion 14. The hanger portion 18 extends substantially across the rear side of the card portion 14 in a substantially horizontal disposition and it includes an upper portion 20 which extends rearwardly from the upper edge of the card portion 14 and a rear portion 22 which extends downwardly and angularly inwardly slightly and then angularly outwardly slightly as illustrated. The hanger member 14 is adapted to be received on a substantially horizontal hanger bar of a conventional display stand of the general type disclosed in the U.S. Pat No. 4,322,007 to Feibelman.

The earrings 12 comprise three-dimensional mobile-type earrings and they each include a plurality of rings 24 of different diameters which are pivotally suspended from an eye 26 which is attached to a ball element 28. Extending rearwardly from each of the ball elements 28 is a post 30 and a clutch 32 is releasably received on each of the posts 30. The earrings 12 are adapted to be suspended from the ears of a wearer having pierced ears by passing the posts 32 through the pierced apertures in the ears in a conventional manner and then assembling the clutches 32 on the rear sides of the ears. When the earrings 12 are worn in this manner the rings 24 are freely pivotable to positions wherein they are randomly oriented so that the earrings 12 take on decorative three-dimensional forms. However, when the earrings 12 are displayed on the display card 10 the rings 24 thereof are positioned in front of the decorative layer 16 so that they are maintained in substantially coplanar relation. As a result, the earrings are not capable of taking on the true artistic forms which they normally assume once suspended in free space from the ears of a wearer.

Figure 3:
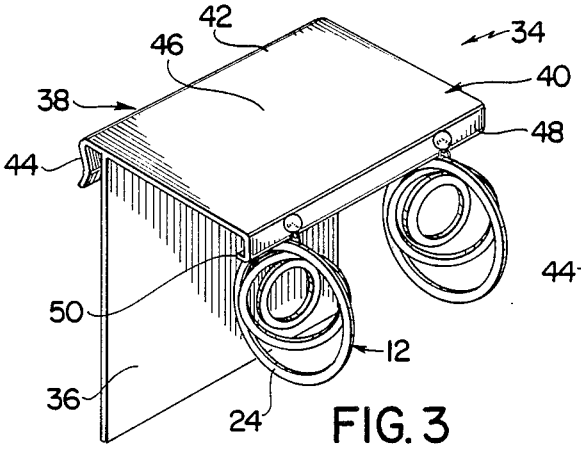
FIG. 3 is a perspective view of the display card of the instant invention as it is used to display a pair of three-dimensional earrings.
Figure 4:
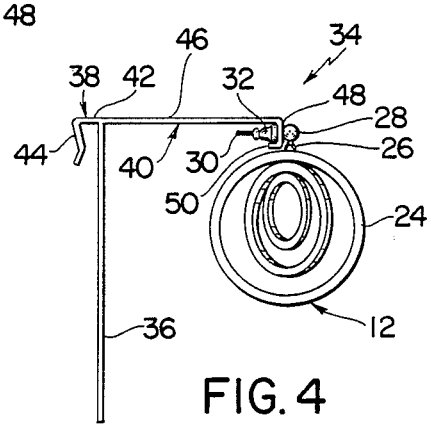
FIG. 4 is a side elevational view thereof.

Referring now to FIGS. 3 and 4, a first embodiment of the display card of the instant invention is illustrated and generally indicated at 34. The display card 34 comprises a substantially rectangular, planar card portion 36, a hanger portion generally indicated at 38 which extends rearwardly from the upper edge of the card portion 36, and a flange portion generally indicated at 40 which extends forwardly from the card portion 36. The card portion 36, the hanger portion 38 and the flange portion 40 are preferably intergrally extruded from a suitable plastic material, although it will be understood that other forms of the display card wherein the card portion 36, the hanger portion 38 and/or the flange portion 40 are formed separately and secured together, such as with an adhesive, are contemplated. The hanger portion 38 is generally similar to the hanger portion 18 and hence, it preferably includes an upper portion 42 which extends rearwardly from the upper edge of the card portion 36 and a rear portion 44 which extends downwardly and angularly inwardly slightly from the upper portion 42 and then downwardly and angularly outwardly slightly. The hanger portion 38 preferably extends across substantially the entire width of the card portion 36 in a substantially horizontal disposition and it is adapted for suspending the display card 34 from a display stand, such as the display stand disclosed in the U.S Pat. No. 4,322,007 to Feibelman. In this regard, however, it will be understood that other embodiments of the display card of the instant invention which include various other hanging means, including one or more hanging apertures in the card portion 36 are also contemplated. The flange portion 40 includes a main or upper portion 46, a front face portion 48, and a bottom lip portion 50. The main portion 46 extends forwardly from the card portion 36 adjacent to the upper end thereof in a substantially horizontal disposition and the front face portion 48 extends downwardly a distance from front extremity of the main portion 46 in forwardly spaced relation to the card portion 36. The front face portion 48 has a pair of spaced apertures therein and the bottom lip portion 50 extends rearwardly slightly from the lower extremity of the face portion 48. The main portion 46 extends forwardly at least approximately one-half inch and preferably approximately one-inch from the main card portion 36 so that the flange portion 40 can be utilized for suspending three-dimensional articles in free space in front of the card portion 36 with the articles spaced forwardly from the front surface of the card portion 36. The front face portion 48 extends downwardly from the main or upper portion 46 in order to provide a substantially vertical mounting surface for earrings or the like so that the earrings can be suspended in dispositions which are similar to those taken on by the earrings during in normal use. In this regard, while the front face portion 48 in the card 34 as herein embodied only extends downwardly from the main or upper portion 46 by a relatively short distance it will be understood that other embodiments wherein the face portion extends downwardly by greater distances to adapt it for receiving various specific types of jewelry items, such as pins and the like are contemplated. The bottom lip portion 50 is operative for concealing the mechanical fasting elements associated with jewelry items displayed on the display card 34.

As illustrated in FIGS. 3 and 4 the display card 34 can be effectively utilized for displaying a pair of three-dimensional ornamental articles, such as the earrings 12 which include rings 24, eyes 26, ball elements 28, post 30 and clutches 32. The display card 34 is adapted to be assembled with the earrings 12 so that the posts 30 thereof pass through the apertures in the front face portion 48 and so that the clutches 32 are assembled on the rear side of the face portion 48. When the earrings 12 are assembled in this manner the rear portions of the posts 30 and the clutches 32 are concealed from view by the face portion 48 and the lower lip portion 50. Further, because the face portion 48 is spaced forwardly from the card portion 36 the earrings 12 are suspended in free space so that the rings 24 thereof can freely rotate into various noncoplanar dispositions. Hence, the earrings 12 are free to take on their natural artistic three-dimensional forms as they are displayed in forwardly spaced relation to the card portion 36. In this regard, it will be understood that the display card 34 can also be effectively utilized for displaying other types of ornamental articles, such as nonpierced earrings which can also be effectively suspended from the flange portion 40 by attaching the fastening elements thereof to the front face portion 48.

Figure 5:
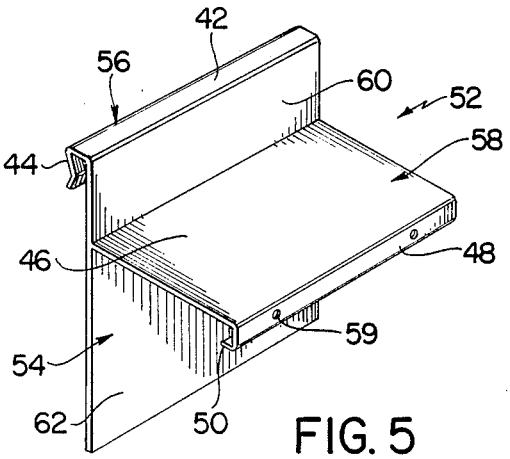
FIG. 5 is a perspective view of a second embodiment of the display card.
Figure 6:
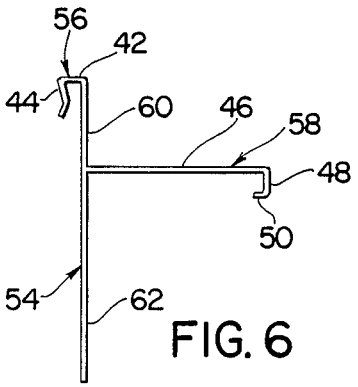
FIG. 6 is a side elevational view thereof.

A second embodiment of the display card of the instant invention is illustrated and indicated at 52 in FIGS. 5 and 6. The display card 52 inc a card portion 54, a hanger portion generally indicated at 56 and a flange portion generally indicated at 58 all of which are integrally formed from a suitable plastic material, although it will be understood that embodiments wherein the display card 52 is formed in two or more pieces which are secured together, such as with a suitable adhesive are contemplated. The card portion 54 is of substantially planar generally rectangular configuration and hence it is generally similar to the card portion 36. The hanger portion 56 is generally similar to the hanger portion 38 and it includes a top portion 42 and a rear portion 44. The flange portion 58 has a pair of apertures 59 therein and it is generally similar to the flange portion 40 and hence it includes a main or upper portion 46, a front face portion 48 and a bottom lip portion 50. However, the flange portion 58 is attached to the card portion 54 so that it extends forwardly in downwardly spaced relation to the upper edge of the card portion 54 and there it divides the card portion 54 into upper and lower sections 60 and 62, respectively. In this regard, it has been found that the upper section 60 provides an effective area for displaying advertising or pricing information whereas the lower section 62 provides a background for ornamental articles displayed on the display card 52. The flange portion 58 is adapted to be used for suspending ornamental articles such as earrings 12 in the manner hereinabove set forth with respect to the flange portion 40 so that the articles are displayed in forwardly spaced relation to the lower section 52.

It is seen therefore that the instant invention provides an effective display card for displaying three-dimensional ornamental articles, such as the earrings 12. In this regard, because the display cards 34 and 52 are adapted for suspending three-dimensional ornamental articles in forwardly spaced relation to the card portions 36 and 54, respectively, thereof, the articles are suspended in free space so that they can assume their normal artistic three-dimensional forms. As a result, the display cards 34 and 52 are substantially more effective for displaying three-dimensional ornamental articles than the previously available display cards, such as the display card 10. For these reasons it is seen that the display card of the instant invention represents a significant advancement in the art relating to jewelry display and packaging devices and that the display card of the instant invention has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A display card for a three-dimensional ornamental pierced earring comprising a card portion having front and rear sides, hanger means on said card portion for releasably hanging said display card from a supporting stand and a flange portion extending forwardly from said front side, said flange portion being adapted for suspending said ornamental earring therefrom and extending forwardly a sufficient distance so that when said display card is hung from said supporting stand with said earring suspended from said flange portion, said earring is positioned in front of said card portion in at least slightly forwardly spaced relation to said front side.

2. In the display card of claim 1, said card portion being substantially flat, said hanger means being adapted for hanging said display card so that said card portion is in a substantially vertical disposition.

3. In the display card of claim 2, said flange portion extending forwardly in a substantially horizontal disposition from said card portion when said card portion is hung from said display stand with said hanger means.

4. In the display card of claim 1, said flange portion including a substantially planar main portion which extends forwardly from said front side and a front face portion which extends downwardly from said main portion in forwardly spaced relation to said card portion, said front face portion being adapted for suspending said earring therefrom so that when said display card is hung from said display stand said earring is spaced forwardly at least slightly from said front side.

5. In the display card of claim 4, said flange portion further comprising a bottom lip portion which extends rearwardly slightly from said front face portion in downwardly spaced relation to said main portion.

6. In the display card of claim 1, said hanger means comprising an elongated hanger member on said card portion extending substantially across the width of said card portion and extending rearwardly from said card portion rear side and then downwardly.

7. In the display card of claim 6, said card portion having an upper edge, said hanger member extending rearwardly from said card portion adjacent said upper edge.

8. In the display card of claim 7, said flange portion extending forwardly from said card portion adjacent said upper edge.

9. In the display card of claim 7, said flange portion extending forwardly from said card portion in downwardly spaced relation to said upper edge.

10. In the display card of claim 1, said card portion, said flange portion and said hanger means being integrally formed from a plastic material.

11. In the display card of claim 1, said flange portion extending forwardly at least approximately one half inch from said card portion and being adapted for suspending said earring therefrom at a point which is spaced forwardly by at least approximately one half inch from said card portion.

12. In the display card of claim 11, said flange portion extending forwardly by approximately one inch from said card portion.

13. In the display card of claim 1, said flange portion being adapted for suspending a pair of said earrings in spaced relation to each other and in forwardly spaced relation to said card portion.

14. A display card for a three-dimensional ornamental article comprising a card portion having front and rear sides, hanger means on said card portion for releasably hanging said display card from a supporting stand and a flange portion extending forwardly from said front side, said flange portion being adapted for suspending said ornamental article therefrom and extending forwardly a sufficient distance so that when said display card is hung from said supporting stand with said article suspended from said flange portion, said article is spaced forwardly at least slightly from said front side, said flange portion including a substantially planar main portion which extends forwardly from said front side and a front face portion which extends downwardly from said main portion in forwardly spaced relation to said card portion, said front face portion being adapted for suspending said ornamental article therefrom.

15. A display card for a three-dimensional ornamental article comprising a card portion having front and rear sides, hanger means on said card portion for releasably hanging said display card from a supporting stand and a flange portion extending forwardly from said front side, said hanger means comprising an elongated hanger member on said card portion extending substantially across the width of said card portion and extending rearwardly from said card portion rear side and then downwardly, said card portion having an upper edge, said hanger member extending rearwardly from said card portion adjacent said upper edge, said flange portion extending forwardly from said card portion in downwardly spaced relation to said upper edge, said flange portion being adapted for suspending said ornamental article therefrom and extending forwardly a sufficient distance so that when said display card is hung from said supporting stand with said article suspended from said flange portion, said article is spaced forwardly at least slightly from said front side.

16. A display card in combination with a three-dimensional ornamental article, said display card comprising a card portion having front and rear sides, hanger means on said card portion for releasably hanging said display card from a supporting stand and a flange portion extending forwardly from said front side, said article being suspended from said flange portion, said flange portion extending forwardly a sufficient distance from said card portion so that when said display card is hung from said supporting stand said article is spaced forwardly at least slightly from said front side, said card portion and said article being constructed such that said article is positioned in front of said card portion when said display card is hung from said supporting stand.

* * * * *